US008528301B1

(12) United States Patent
Robbins et al.

(10) Patent No.: US 8,528,301 B1
(45) Date of Patent: Sep. 10, 2013

(54) UNDER PURLIN FACING SYSTEM

(75) Inventors: Hal J. Robbins, Langhorne, PA (US); John A. Post, Tranquility, NJ (US); Thomas Florian, Brookside, NJ (US)

(73) Assignee: Lamtec Corporation, Mt. Bethel, PA (US)

( * ) Notice: Subject to any disclaimer, the term of this patent is extended or adjusted under 35 U.S.C. 154(b) by 289 days.

(21) Appl. No.: 12/634,231

(22) Filed: Dec. 9, 2009

Related U.S. Application Data

(60) Provisional application No. 61/121,165, filed on Dec. 9, 2008.

(51) Int. Cl.

| | |
|---|---|
| ***E04B 1/00*** | (2006.01) |
| ***E04B 5/00*** | (2006.01) |
| ***E04G 21/00*** | (2006.01) |
| ***E04G 23/00*** | (2006.01) |
| ***E04G 21/14*** | (2006.01) |
| ***E04D 15/00*** | (2006.01) |
| ***E04F 21/00*** | (2006.01) |
| ***B65H 23/00*** | (2006.01) |
| ***B65H 57/18*** | (2006.01) |

(52) U.S. Cl.
USPC ..... 52/748.11; 52/408; 52/746.1; 52/749.1; 52/749.15; 242/566; 242/590; 242/615.4

(58) Field of Classification Search
USPC ..... 52/408, 749.1, 748.11, 746.1, 749.15, 52/749.12; 242/566, 570, 590, 594.6, 615.4
See application file for complete search history.

(56) References Cited

U.S. PATENT DOCUMENTS

| | | | | |
|---|---|---|---|---|
| 4,635,423 | A * | 1/1987 | Ward | 52/746.1 |
| 5,653,081 | A | 8/1997 | Wenrick et al. | |
| 5,724,780 | A | 3/1998 | Bolich | |
| 6,308,489 | B1 | 10/2001 | Romes | |
| 6,393,797 | B1 * | 5/2002 | Romes | 52/746.1 |
| 6,705,059 | B2 * | 3/2004 | Romes | 52/749.12 |
| 6,769,223 | B2 | 8/2004 | Alderman | |
| 2001/0052395 | A1 | 12/2001 | Zupon et al. | |
| 2002/0144485 | A1 | 10/2002 | Wagner | |
| 2003/0056464 | A1 * | 3/2003 | Romes | 52/749.12 |

* cited by examiner

*Primary Examiner* — Andrew Triggs
(74) *Attorney, Agent, or Firm* — Fay Sharpe LLP

(57) ABSTRACT

A method of facing a roof structure includes securing a facing to respective lower flanges of first and second spaced-apart purlins of the roof structure, with the facing extending directly between the respective lower flanges of the first and second purlins. A carriage is suspended from purlins of the roof structure and supports a roll of facing. The facing is dispensed and adhesively secured to the purlins by moving the carriage relative to the purlins and/or by maintaining the carriage in a stationary position and pulling facing from the roll of facing supported on the carriage. The resulting faced roof structure provides an enhanced appearance and more uniform and higher R-value insulation.

2 Claims, 11 Drawing Sheets

REPLACEMENT SHEET

UNDER PURLIN FACING SYSTEM

CROSS-REFERENCE TO RELATED APPLICATION

This application claims priority from and benefit of the filing date of U.S. provisional patent application Ser. No. 61/121,165 filed Dec. 9, 2008, and the full disclosure of said provisional application is hereby expressly incorporated by reference into the present application.

BACKGROUND

FIG. 1 illustrates a known (prior art) building roof structure R comprising a corrugated metal or other roof deck D supported on plurality of parallel, spaced-apart purlins, trusses or other structural members P that extend axially along respective longitudinal axes PX that each extend perpendicularly into and out of the page as shown in FIG. 1. Between each successive pair of purlins P, an open bay BA is defined, and the roof deck D spans the bays BA. It is known to insulate the roof deck D with a known roof insulation system 10. Typically, as shown in FIG. 1, the known roof insulation system 10 comprises a vapor retarder facing or web or sheet S draped over the respective upper flanges or edges PU of multiple (at least two) successive purlins P so that the sheet S spans and drapes across one or more bays BA. The vapor retarder sheet S is fixed to at least some or all of the purlins P over which it is draped using suitable fasteners, adhesive or other means. The vapor retarder sheet S is a single layer or multiple layer product, e.g., single-layer vinyl film/sheet or other film/sheet, or a laminated composite containing various combinations of aluminum foil, polymeric film/sheet, kraft paper, reinforcing yarns and/or fabrics. Vapor retarder sheets S vary in strength, color, light reflectivity, and their ability to retard moisture migration therethrough. An insulation space SP is thus defined between the inner face S1 of the sheet S and the roof deck D, and fiber glass or other insulation I is laid or blown or otherwise installed in the insulation space SP and is supported on the inner face S1 of the vapor retarder sheet S and/or laminated to the inner face S1 vapor retarder sheet S. The vapor retarder sheet S supports and faces the insulation I, inhibits migration of moisture into the insulation and improves aesthetics of the interior of the building.

The roof insulation system 10 of FIG. 1 has been found to be suboptimal in certain cases. For example, the draped vapor retarder sheet S limits the amount of insulation that can be installed in the bay BA, and the insulation is uneven between the central portion of the bay and the edges adjacent the purlins P. The sheet S can be stretched too taught across the bay BA, which shortens the insulation space SP. As such, the R-value achievable with the system 10 of FIG. 1 can sometimes be limited and/or inconsistent. Also, some people find the draped facing sheet S to lack the desired aesthetics for a roof structure due to the exposed purlins and uneven appearance.

SUMMARY

In accordance with one aspect of the present development, a method of facing a roof structure includes securing a facing to respective lower flanges of first and second spaced-apart purlins of the roof structure, with the facing extending directly between the respective lower flanges of the first and second purlins.

In accordance with another aspect of the present development, a roof structure includes first and second purlins each comprising a lower flange. Facing extends directly between the respective lower flanges of the first and second purlins.

In accordance with another aspect of the present development, a carriage for dispensing facing for a roof structure includes a base adapted to support an associated roll of facing. First and second feet are connected to the base and are adapted to movably engage first and second associated purlins for suspending the base beneath the first and second associated purlins.

DETAILED DESCRIPTION

Figure 2:
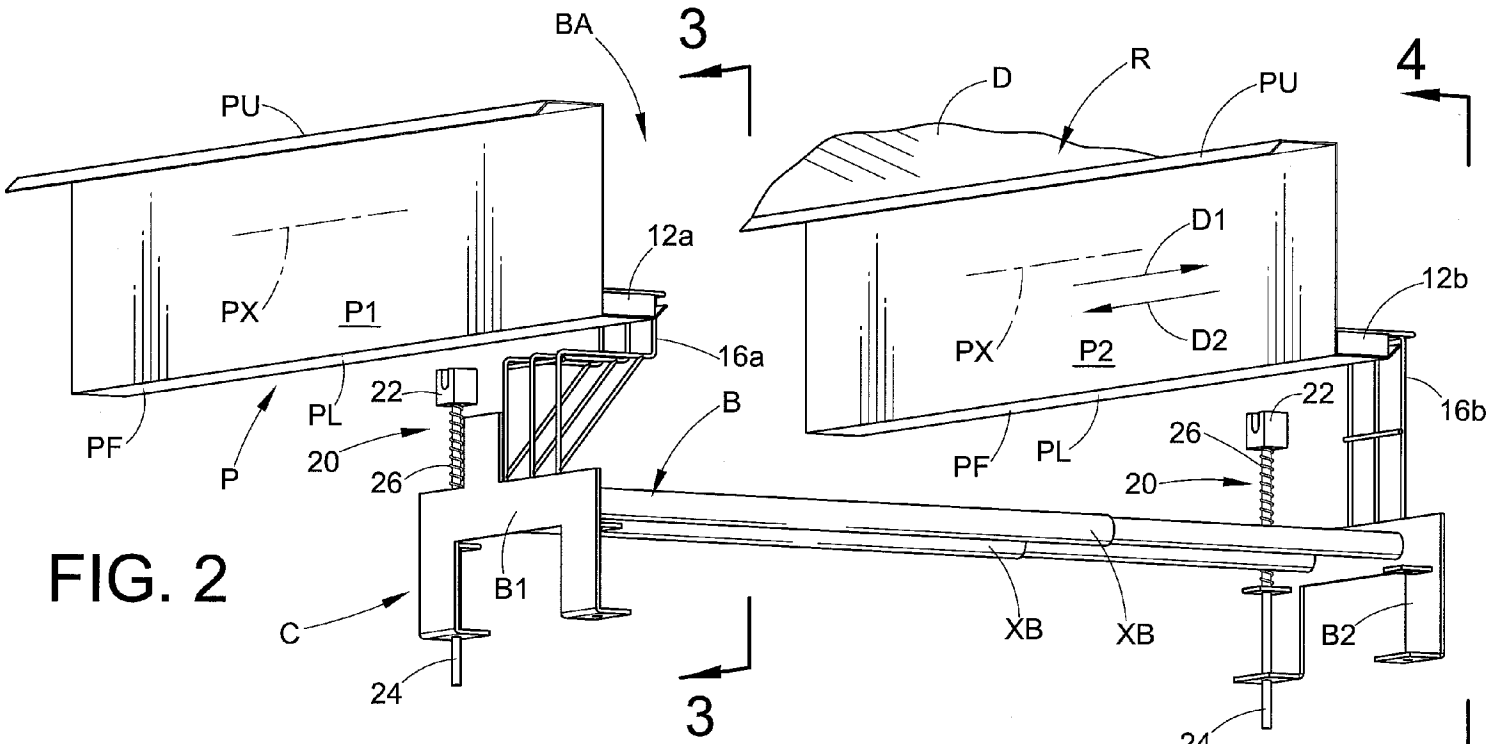
FIG. 2 is an isometric view of the roof structure of FIG. 1 (or the like) and showing one embodiment of a carriage used to implement a facing system and method in accordance with the present development.

FIG. 2 illustrates the known building roof structure R as generally described above, comprising a corrugated metal or other roof deck D supported on plurality of parallel, spaced-apart purlins P (only first and second purlins P1,P2 are shown in FIG. 2). Between each successive pair of purlins P, an open bay BA is defined, and the roof deck D spans the bays BA. According to the present development, in order to insulate the roof structure R, a vapor retarder facing or other facing F (see FIGS. 2B and 7) is secured to bottom face PF of the lower flange PL of multiple (at least two) parallel spaced-apart purlins P so that the facing F directly spans one or more bays BA, without being draped over the upper flanges PU of the purlins P. Each bay BA is then at least partially filled with fiber glass or other insulation that is supported on the facing F. As described in further detail below, the facing F is initially fixedly secured to the bottom face PF of each purlin lower flange PL using adhesive (for example, double-sided tape or other adhesive) and, preferably, is thereafter more permanently secured using screws and/or other mechanical fasteners that connect to the purlins P. The facing F, itself, comprises a single layer or multiple layer product, e.g., single-layer vinyl film/sheet or other film/sheet, or a laminated composite containing various combinations of aluminum foil, polymeric film/sheet, kraft paper, reinforcing yarns and fabrics. Facings F vary in strength, color, light reflectivity, and their ability to retard moisture migration therethrough. As noted, the facing F can inhibit migration of moisture into the insulation (if the facing F is constructed as a vapor retarder) and improves aesthetics of the interior of the building. In some applications, the facing F is perforated or otherwise constructed to allow migration of moisture therethrough. Regardless of the exact structure of the facing, the terms "sheet" or "web" as used herein are intended to refer to a length of the facing F having a width sufficient to span the bay BA so as to extend directly between the lower flanges PL of the purlins P1,P2.

Figure 1:
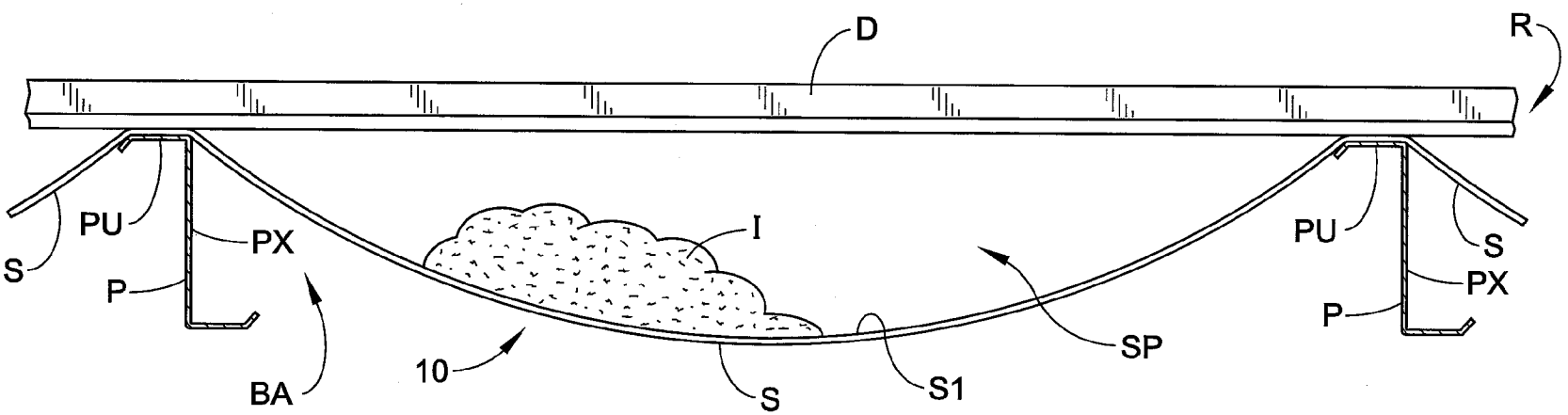
FIG. 1 (PRIOR ART)
FIG. 1 (prior art) illustrates a known roof structure and known insulation system.
Figure 2A:
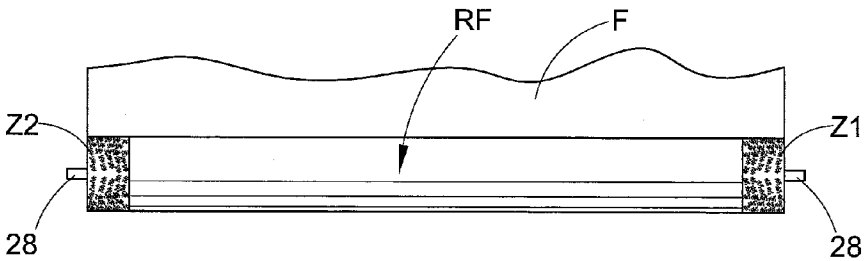
FIG. 2A shows one example of an associated roll of facing to be dispensed from the carriage of FIG. 2.
Figure 2B:
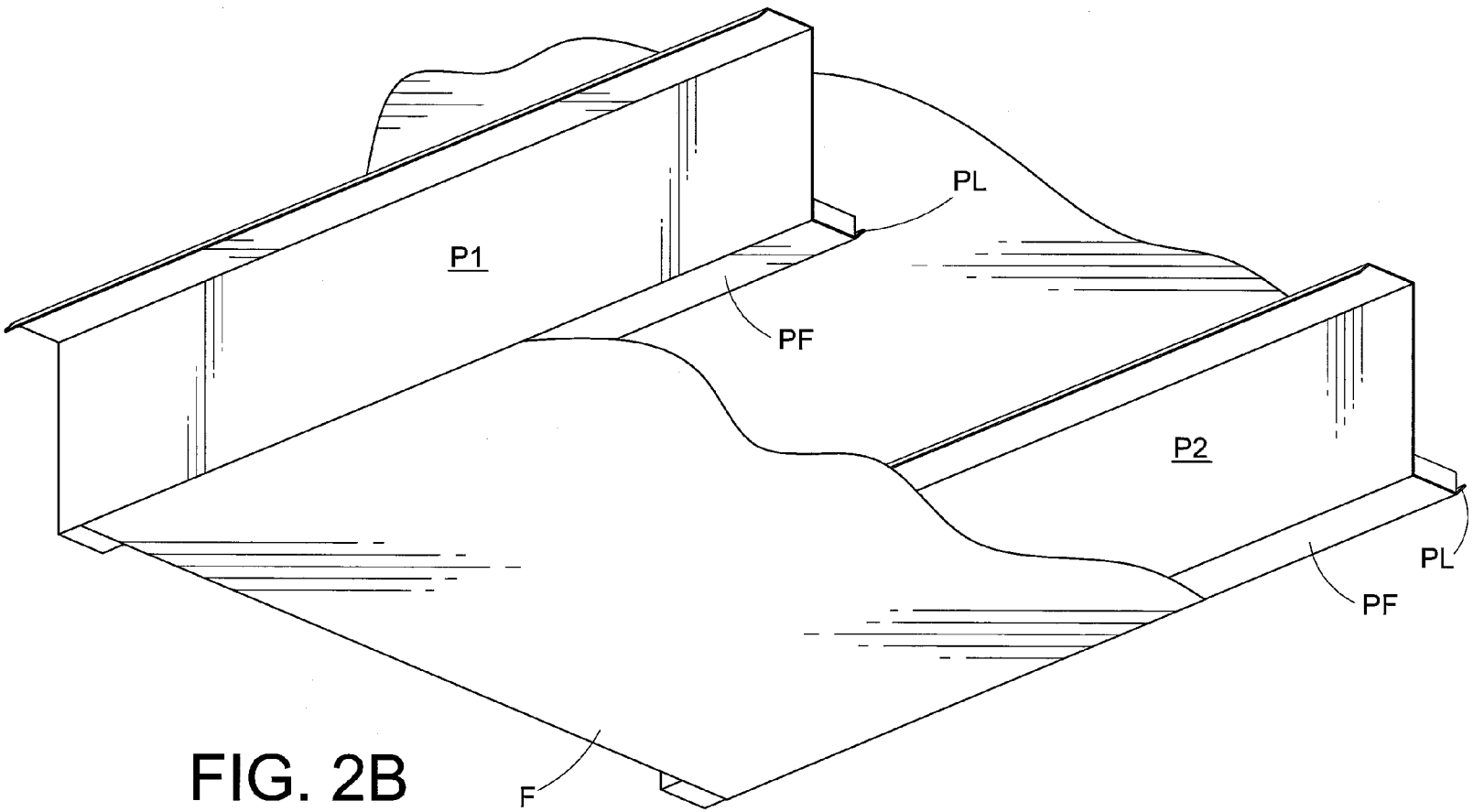
FIG. 2B shows a roof structure including facing installed according to the present system and method.

As shown in FIG. 2, according to the present development, the facing F is installed using a carriage C that is temporarily secured to/suspended from and moved along at least two of the purlins P1,P2, parallel to the longitudinal axes PX thereof. The carriage C is adapted to carry one or more rolls RF (FIG. 2A) of the facing F and to dispense the facing for securement to the lower flanges PL at least two of the purlins P1,P2 by tape or other adhesive. More particularly, the carriage C is adapted to be movably secured to the lower flanges PL and ride along same in a direction D1 parallel with the axes PX of the purlins P1,P2 and to dispense the facing F from the roll RF as it moves along the purlins. As shown in FIG. 2A, the facing F includes double-sided tape or other first and second adhesive zones Z1,Z2 respectively located at least adjacent its opposite first and second lateral sides that adhere to the bottom face PF of the purlin lower flange PL to secure the facing F to the purlins (the adhesive zones Z1,Z2 can be separate zones or can both be part of a larger single adhesive area). Alternatively, adhesive (e.g., double-sided tape or other adhesive) can first be applied to the bottom face PF of the purlin lower flanges PL through a manual process or using the carriage C to define the first and second adhesive zones Z1,Z2. After the facing F is dispensed from the carriage C and adhered to the purlins P, optional screws, clips and/or other mechanical fasteners can be installed using conventional methods, e.g, screws installed through the facing into the lower flange PL, for strengthening the connection between the facing F and the purlins P. Unlike known system such as that shown in FIG. 1, the facing F extends directly between the lower flanges PL, meaning that the facing F is not draped over the purlin upper flanges PU. The carriage C is adapted to be temporarily and movably engaged with first and second parallel spaced-apart purlins P (P1,P2), with a base B of the carriage C suspended beneath the purlins. As shown, the carriage C is movably engaged with successive purlins P1,P2, but the carriage can be sized to by movably engaged with any two (or more) parallel spaced apart purlins P. In the illustrated embodiment, the carriage C is adapted to be movably engaged with the lower flanges PL of the first and second purlins P1,P2 and comprises first and second feet 12*a*,12*b* adapted to be received on an inner/upper surface of the lower flanges PL. The feet 12*a*,12*b* are adapted to slide, roll or otherwise movably engage the flanges PL for movement in a direction D1 or opposite direction D2 parallel to the longitudinal axes PX of the purlins, and the feet 12*a*,12*b* are preferably conformed and dimensioned to minimize movement transverse to the longitudinal axes PX. As shown, the feet 12*a*,12*b* are adapted to slide on the flanges PL, but the feet 12*a*,12*b* can include rollers, wheels or other means for moving on the flanges PL. Alternatively, the feet 12*a* can movably engage any other part of the purlins P1,P2 without departing from the overall scope and intent of the present development.

Figure 4:
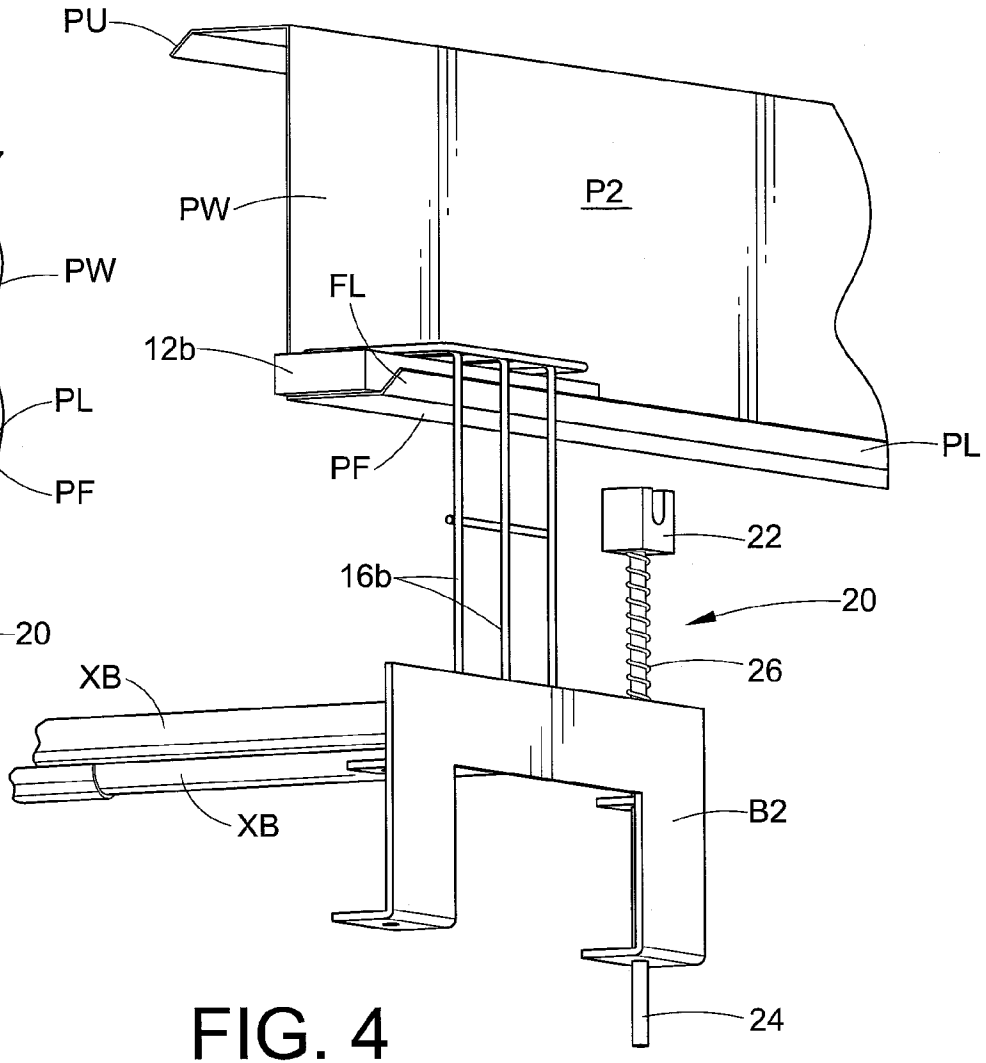
FIG. 4 is a view taken at view line 4-4 of FIG. 2 and shows the second base portion of the carriage of FIG. 2.
Figure 3:
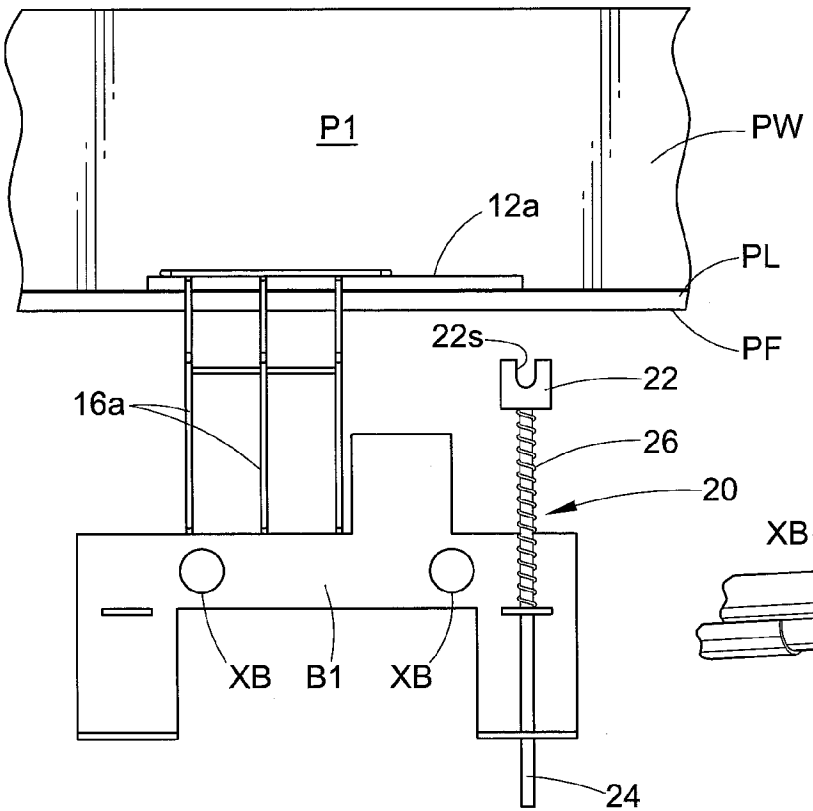
FIG. 3 is a view taken at view line 3-3 of FIG. 2 and shows the first base portion of the carriage of FIG. 2.
Figure 5:
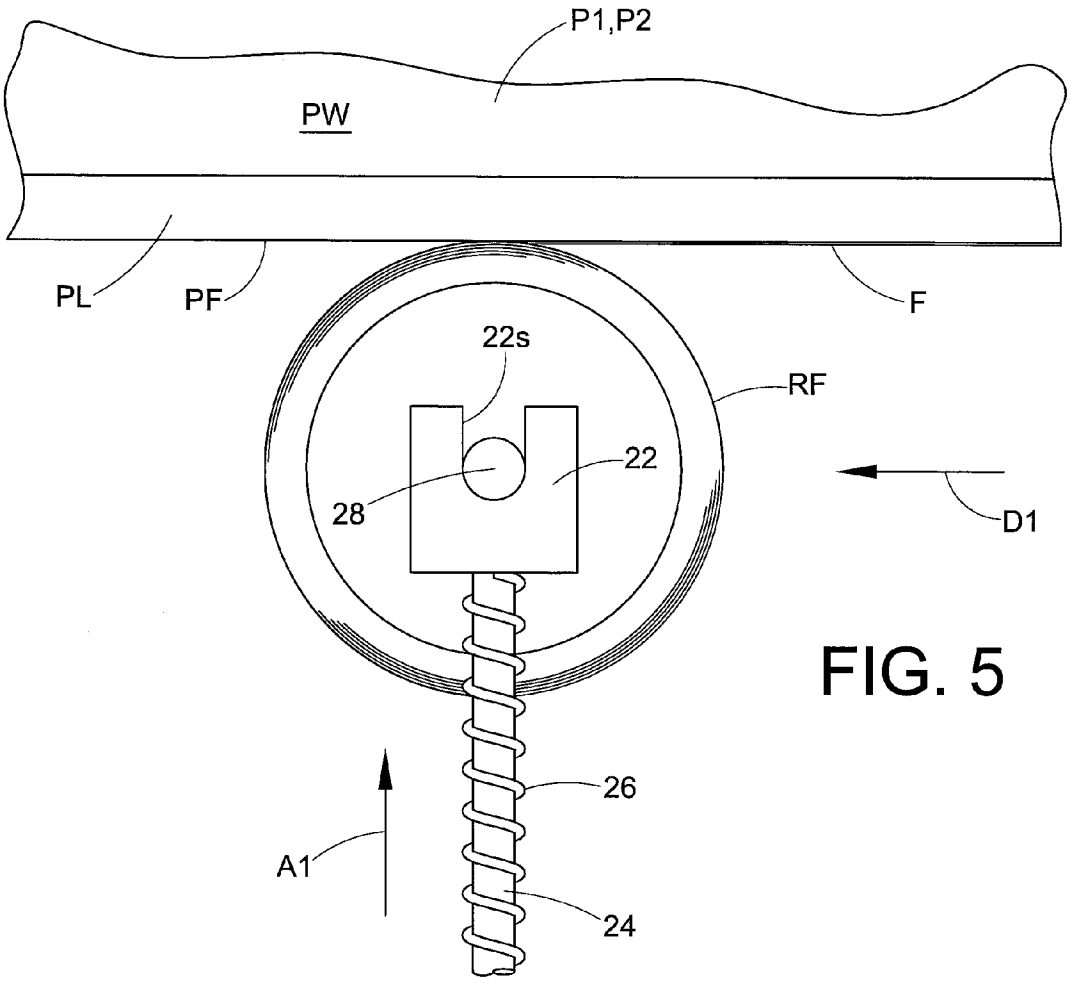
FIG. 5 shows one example of a roll support device of the carriage of FIG. 2 and shows the facing roll of FIG. 2A operably supported thereby.

The base B of the carriage C comprises first and second base portions B1,B2 connected to each other by one or more cross-members XB. The cross-members are selectively adjustable in length to allow the spacing between the first and second base portions B1,B2 to be adjusted and fixed as desired so that the carriage C can be sized to engage first and second purlins P1,P2 laterally spaced from each other at various distances, such as 5 feet or more or less. The adjustable-length cross-members XB are important because purlin spacing will vary from building to building or even within the same roof structure R. In one example, the cross-members XB are telescoping poles that include a lock that allows the poles to be fixed at a desired length. The first and second base portions B1,B2 are adapted to be located generally beneath and in lateral alignment with the lower flanges PL of the first and second purlins P1,P2, respectively. The first base portion B1 is connected to the first foot 12*a* via one or more first struts 16*a*, and the second base portion B2 is connected to the second foot 12*b* via one or more second struts 16*b*. In one embodiment, the carriage C is constructed from steel alloy or other metal components welded or otherwise connected together (e.g., metal stampings or extrusions or other structures), or can be constructed from metal wire and/or polymeric components, as a one-piece or multi-piece structure, and the illustrated structure for the carriage C is only one example not intended to limit the present development in any way. The feet 12*a*,12*b* can be defined from a durable polymeric material with a low coefficient of friction and/or can include wheels or the like. The first and second base portions B1,B2 are shown separately in FIGS. 3 and 4, with views taken at 3-3 and 4-4 of FIG. 2, respectively. As seen in FIG. 4, the feet 12*a*,12*b* are preferably conformed and dimensioned to fit closely between the vertical web PW of the purlin and the upturned lip FL to minimize lateral movement of the feet 12*a*,12*b* transverse to the longitudinal axis PX of the purlin P.

The base B includes a roll support device or other roll support means for supporting a roll RF of the facing F and for dispensing facing from the roll RF. In the illustrated embodiment of FIGS. 2-5, the bases B1,B2 comprise respective roll support device 20 comprising a roll support block 22 connected to a shaft 24. The shaft 24 is slidably connected to the respective base portion B1,B2. The roll support block 22 is adapted for vertical movement relative to its respective base B1,B2 between an extended position (closer to the purlin lower flange PL) and a retracted position (spaced farther away from the purlin lower flange PL). Means are provided for biasing each roll support block 22 to its extended position. In the illustrated embodiment, the above is accomplished connecting each shaft 24 slidably to its respective base B1,B2 and by including a coil spring 26 that is coaxially located about each shaft 24 and operatively engaged between its respective base B1,B2 and the support block 22 and/or shaft 24.

As shown in FIG. 2A, in one example, each facing roll RF can include first and second spindles 28 removably inserted in its opposite ends or otherwise projecting from its opposite ends such as, e.g., the spindles 28 being connected to or defined by the opposite ends a shaft or core that extends through the roll RF. The roll support blocks 22 each include a slot 22*s* (FIG. 5) or other structure for receiving and rotatably supporting one of the spindles 28 so that the roll RF extends between the roll support blocks 22 of the bases B1,B2 and is rotatably supported for dispensing the facing F from the roll RF onto the purlin lower flange PL. The roll support devices 20 bias the roll RF upward as indicated by arrow A1 into operative engagement with the bottom face PF of the purlin lower flanges PL such that when the carriage C is moved relative to the purlins P1,P2 in the direction D1, the first and second adhesive zones Z1,Z2 of the roll RF adhere the facing F to the purlin lower flanges PL as the facing F is dispensed from the roll. In an alternative embodiment, the roll RF, itself, is not biased into contact with the purlins P. Instead, one or more idler rollers or blades, or other means are used to press the facing F into contact with the purlin flanges PL after the facing is unwound from the roll RF.

It should be noted that adjacent bays BA of a roof structure R will be faced in a successive manner, by engaging the carriage C with each adjacent successive bay BA after facing a previous bay, i.e., after a bay BA is faced, the carriage C is moved to and engaged with the next bay BA. Also, those of ordinary skill in the art will recognize that the installed facing F of a previous bay BA will require that the bays BA be faced in a specified order/direction to allow unobstructed access to the purlin lower flanges PL for the carriage feet 12*a*,12*b* to be seated thereon (the bays BA will be faced staring with the most upstream bay and moving downstream from bay-to-bay in the direction that the flanges PL extend from the vertical web PW of the purlins P).

Furthermore, the facing F will typically overlap on the purlin lower flange PL and define a seam between successive adjacent bays BA. This overlapped seam is highly desired when the facing F is a vapor retarder facing and the facing is sealed by an adhesive such as tape or otherwise continuously sealed along the overlapped seam so that a continuous vapor barrier/Vapor Retarder Liner is formed by the successive overlapped strips of facing F. As used herein, the facing F is deemed to be adhered or otherwise connected to a purlin lower flange PL if the facing F is directly in contact with the purlin lower flange PL and/or if an intervening layer of tape or another layer of adhesive or facing F or other material is located between the facing F and the purlin lower flange PL. Thus, the facing F is deemed to be adhered to the purlin lower flange PL when adhered directly to the purlin lower flange PL and/or if the facing F is connected to and overlapped with another piece of facing F that is connected directly or indirectly to the purlin lower flange PL.

Figure 6:
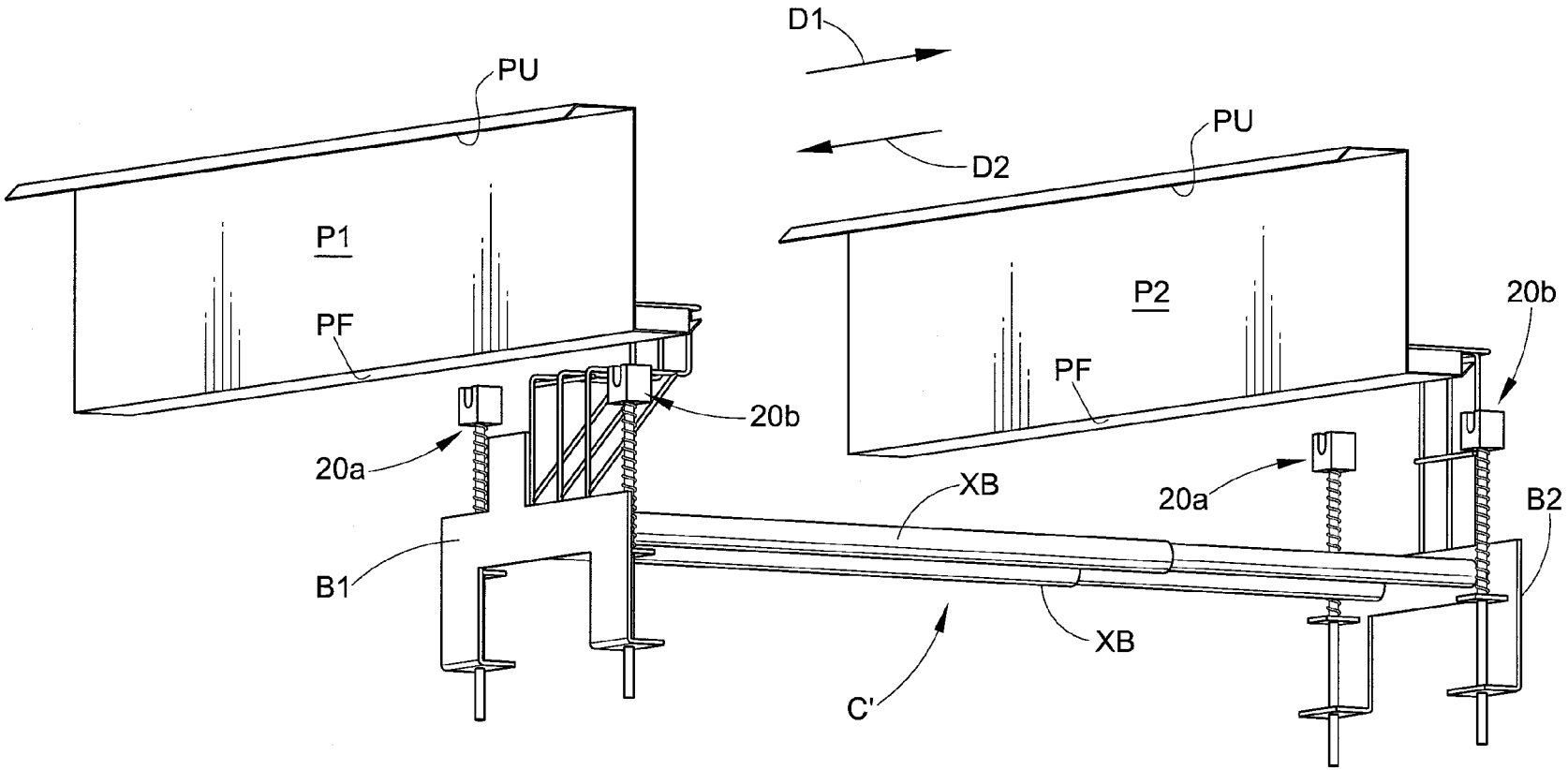
FIG. 6 shows an alternative embodiment of a carriage in accordance with the present development.

FIG. 6 shows an alternative carriage embodiment C' that is identical to the carriage C, except that the first and second bases B1,B2 of the carriage C' each include first and second roll support devices 20*a*,20*b* each defined as described above for the roll support devices 20. With the carriage C', the facing F must be dispensed from the roll RF behind the struts 16*a*, 16*b* in terms of the carriage movement direction so as not to obstruct movement of the feet 12*a*,12*b* on the purlin flanges PL. As such, the respective first roll support devices 20*a* are adapted to support and dispense a roll of facing RF when the carriage is moving in direction D1, and the respective second roll support devices 20*b* are adapted to support and dispense a roll of facing RF when the carriage C is moving in the opposite direction D2. In one alternative embodiment, the second roll support devices 20*b* are each separately adapted to support and dispense double-sided tape from respective separate, individual rolls onto the bottom faces PF of the lower flanges PL of the purlins P1,P2, with the first roll support devices 20*a* dispensing facing F from a roll RF to be adhered to the purlin lower flanges PL via the tape dispensed from the device 20*b* when the carriage C is moving in direction D1 (if the carriage is moving in direction D2, the first roll support devices 20*a* are each separately adapted to support and dispense double-sided tape from respective separate, individual rolls onto the lower flanges PL of the purlins P1,P2, with the second roll support devices 20*b* dispensing facing F from a roll RF). As an alternative to double-sided tape, the first roll support devices 20*a* (for moving in direction D2) or second roll support devices 20*b* (for moving in direction D1) can be replaced by or used to support devices for dispensing a spray or bead or other layer or deposit of liquid or other adhesive onto the respective lower flanges PL of the first and second purlins P1,P2, after which facing F is adhered to the lower flanges PL as dispensed from a roll RF supported by the first roll support devices 20*a* (for moving in direction D1) or second roll support devices 20*b* (for moving in the direction D2).

It is not intended that the carriage C,C' and/or roll support devices 20 (20*a*,20*b*) be limited to the embodiments shown. Also, the roll RF of facing F can include a core or be coreless, and can include the spindles 28 or not, and can include a central shaft extending therethrough or not, and the structure of the roll support devices 20 will vary accordingly in order to rotatably support the roll RF for dispensing facing F therefrom to be adhered to the purlin lower flanges PL in response to movement of the carriage C along the purlins P1,P2 in the direction D1 or D2.

FIGS. 7-10 disclose another alternative carriage 2C for implementing the system and method of the present development. Like components relative to the carriage C are identified with like reference numbers/letters. The base B comprises first and second base portions B1,B2 interconnected by adjustable-length cross-members XB. A first foot 12*a* is connected to the first base portion B1 by a first strut 16*a*, and a second foot 12*b* is connected to the second base portion B2 by a second strut 16*b*. The first and second feet 12*a*,12*b* are adapted to be slidably supported on and engaged with the lower flanges FL of the first and second purlins P1,P2, respectively, for movably supporting the carriage 2C for movement in the first direction D1. The first and second feet are pivotally connected to the respective struts 16*a*,16*b* by respective pivoting connections V (see FIG. 10).

The base B is adapted to rotatably support a roll of facing RF for dispensing facing F from the roll for adhesive securement to the bottom surface PF of the purlin lower flanges PL. As shown, the roll RF is supported by use of spindles 28 in its ends, with the spindles 28 secured to the respective base portions B1,B2. Alternatively, a rod or the like can extend between the base portions B1,B2 and the roll RF is rotatably carried on the rod.

Figure 7:
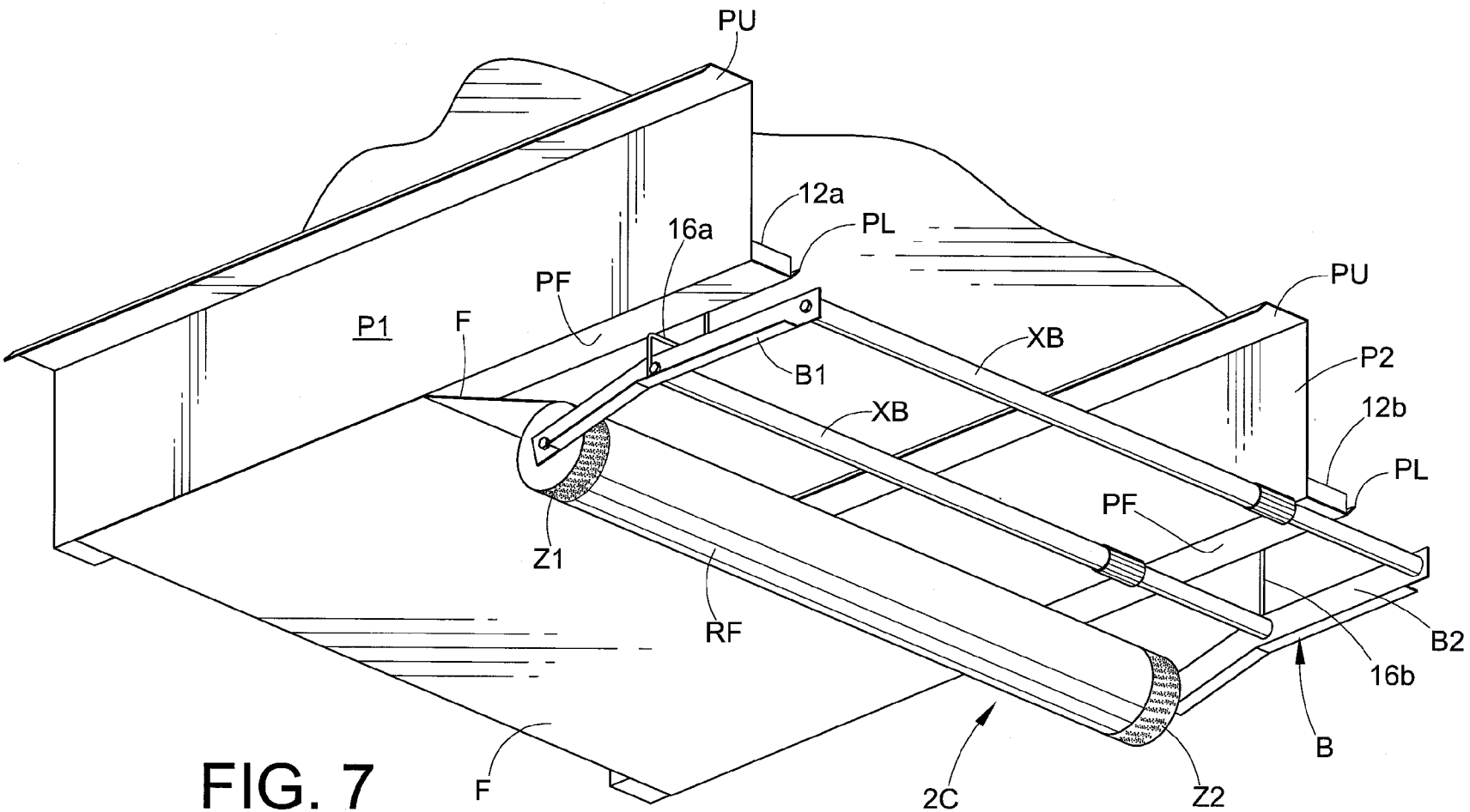
FIG. 7 is an isometric view of the roof structure of FIG. 1 (or the like) and showing another alternative embodiment of a carriage used to implement a facing system and method in accordance with the present development.
Figure 8:
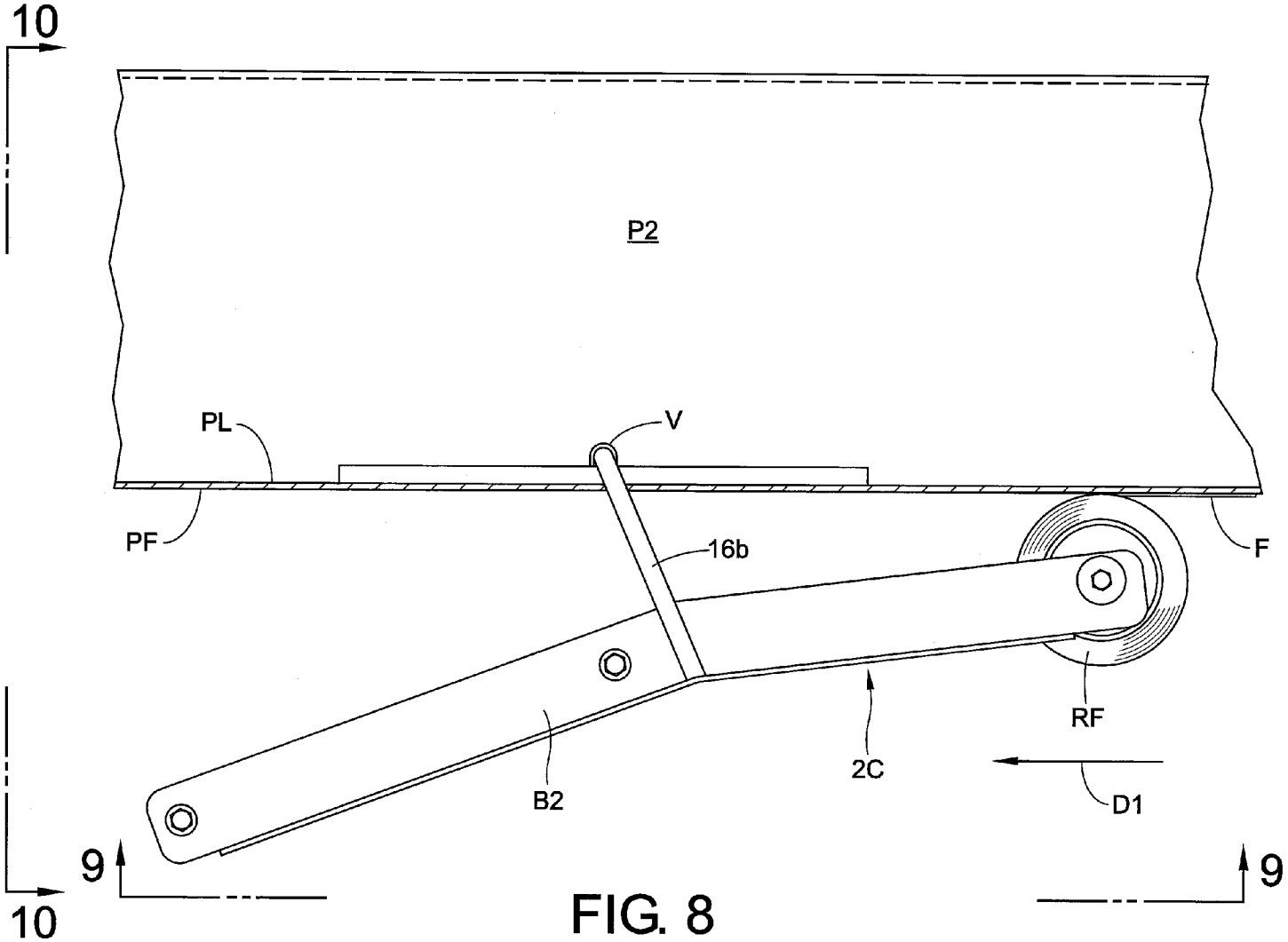
FIG. 8 is a side view of the carriage of FIG. 7, pivoted to its operative position for installing facing in accordance with the present development.

FIG. 7 shows the base B in a free state, where the roll RF is not operably engaged with the purlins P1,P2. In use, as shown in FIGS. 8-10, a user grasps the outermost cross-bar XB (farthest from facing roll RF) as a handle and pulls downward away from the purlins P1,P2 to pivot the base B such that the roll RF is moved upward into contact with the bottom faces PF of the lower flanges PL, while the user simultaneously pulls the carriage in the direction D1 to dispense the facing F from the roll RF as described above. The facing includes first and second adhesive zones Z1,Z2 (FIG. 7) that adhere the facing F to the purlins P1,P2 as the carriage is moved in the direction D1. As noted above, the facing is thereafter more permanently secured using screws or other fasteners that engage the purlin lower flange PL. For the carriage 2C and all other embodiments disclosed herein, after the carriage is operably suspended from the purlins P1,P2, the user can start the facing operation by pulling some facing from the roll RF and adhering same to the bottom face PF of the lower flanges PL.

Figure 9A:
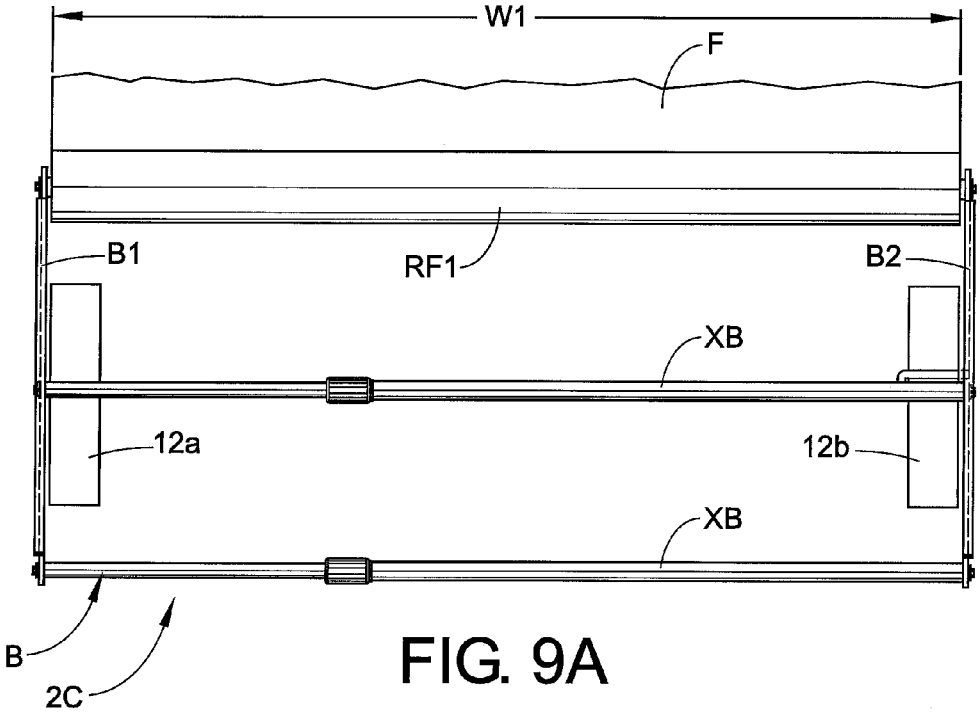
FIGS. 9A and 9B are views of the carriage as taken along view line 9-9 of FIG. 8, with FIG. 9A showing the carriage in an extended condition for use with a first (wider) purlin spacing and FIG. 9B showing the carriage in a retracted condition for use with a second (shorter) purlin spacing.
Figure 9B:
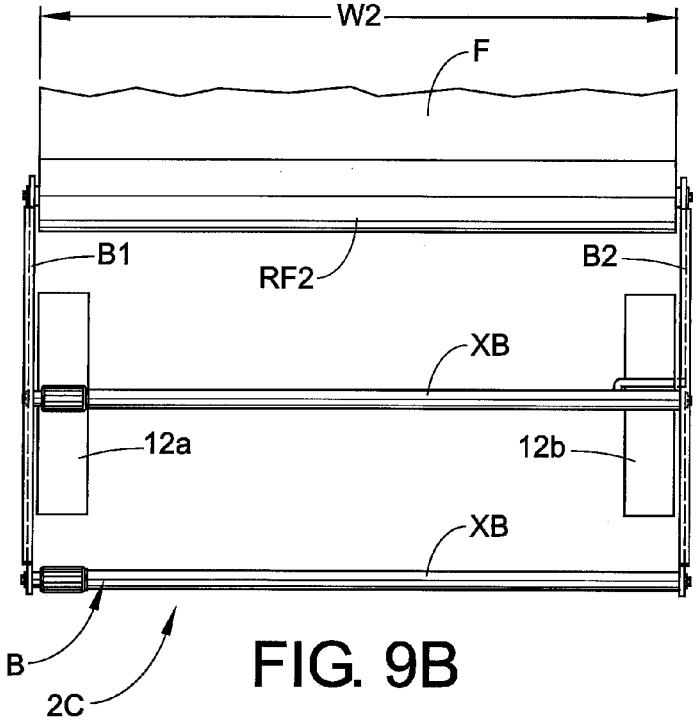
Figure 10:
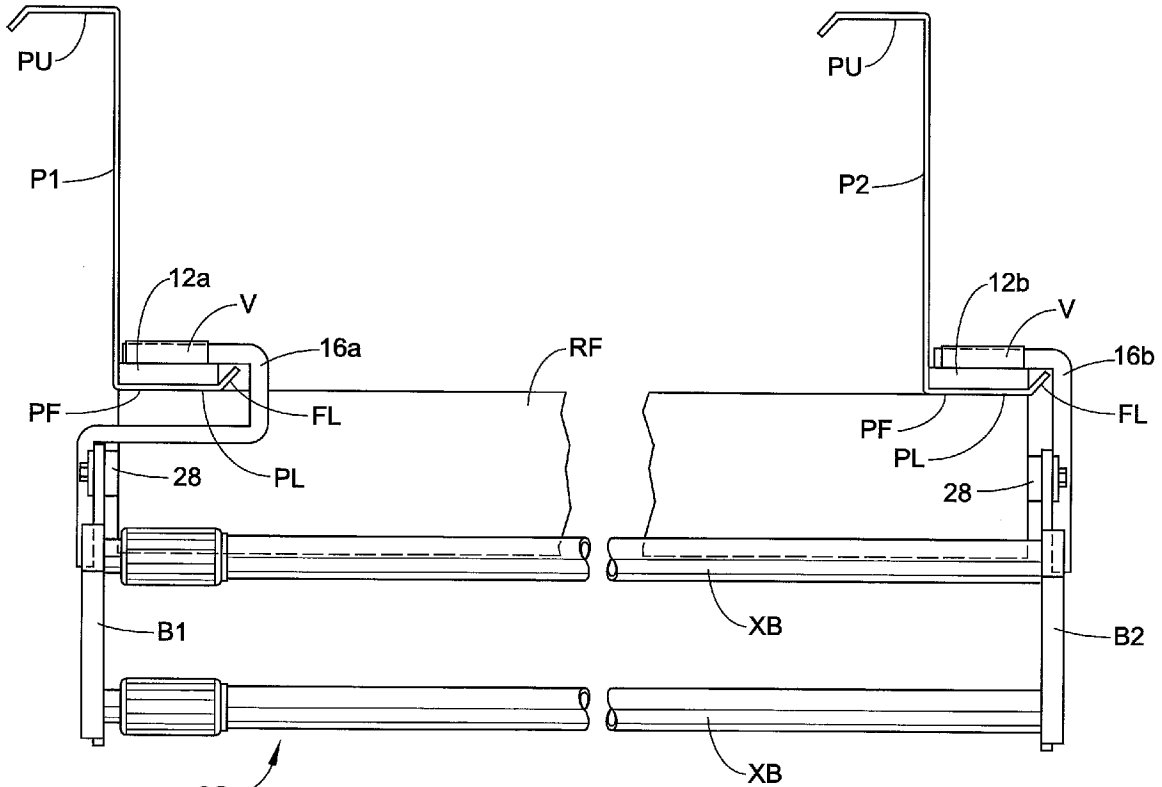
FIG. 10 is a view of the carriage and associated roof purlins as taken along view line 10-10 of FIG. 8.

FIG. 9A shows the carriage 2C with the adjustable-length cross-members XB extended in order for the base B to accommodate a roll of facing RF1 having a width W1 for a first purlin spacing distance. FIG. 9B shows the carriage 2C with the adjustable-length cross-members XB retracted in order for the base B to accommodate a roll of facing RF2 having a width W2 for a second purlin spacing distance.

Figure 11:
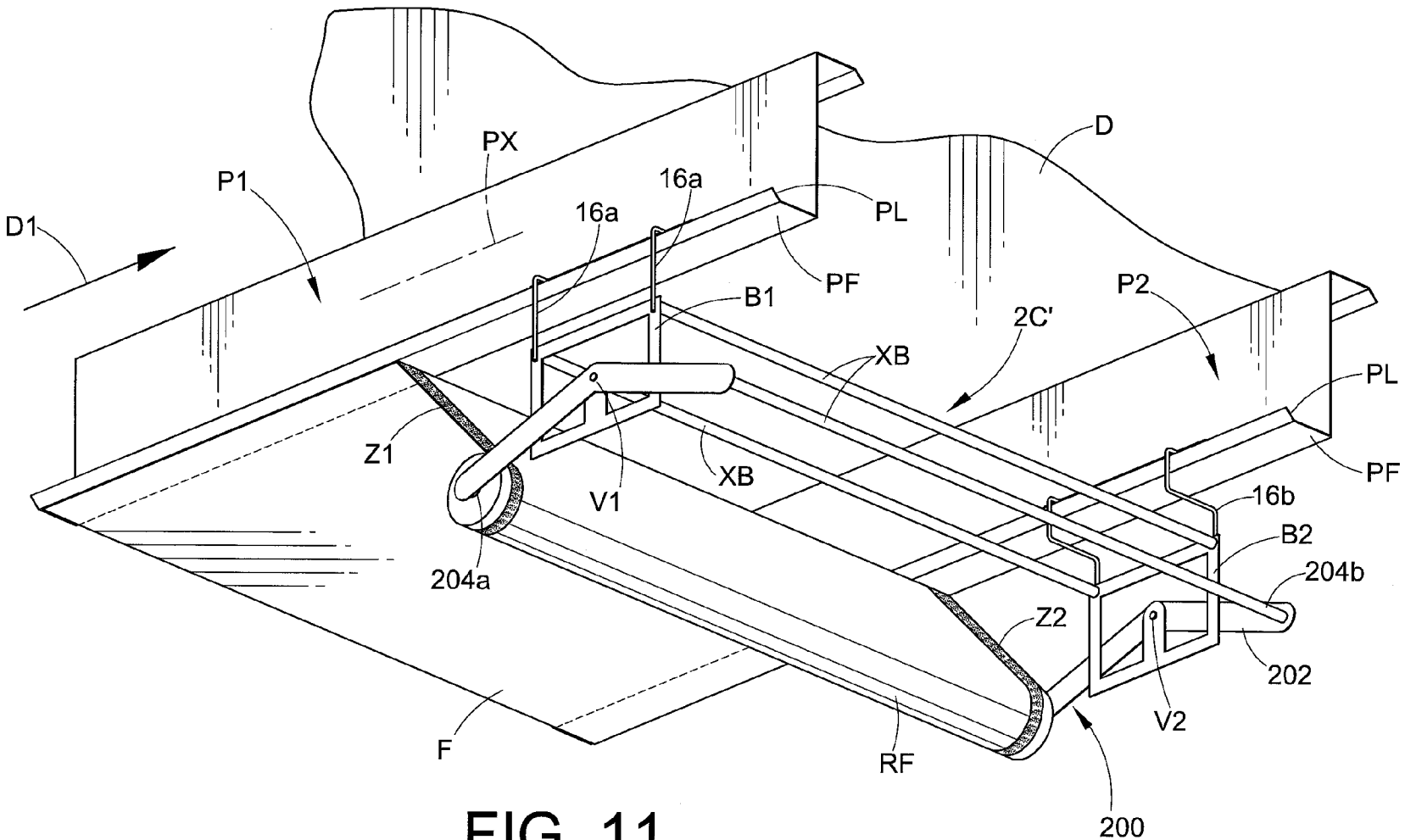
FIG. 11 is a view similar to FIG. 7, but showing another alternative embodiment of a carriage formed in accordance with the present development.

FIG. 11 shows an alternative carriage 2C' in which the roll support devices 20 of the carriage C are replaced by a roll support device 200 that comprises a frame 202 pivotally connected to the first and second base portions B1,B2 at pivot points V1,V2. The frame 202 includes at least one and preferably first and second roll supports 204 (204*a*,204*b* as shown) on which a roll RF of facing F is rotatably supported for dispensing onto the purlin lower flanges PL as described above. As shown, the first and second roll supports 204*a*,204*b* comprise respective adjustable-length rods 205 on which the roll RF is rotatably supported. In the embodiment of FIG. 11, when a roll RF is carried by one of the roll supports 204*a*, 204*b*, the other roll support 204*a*,204*b* serves as a handle for grasping by a user to move the carriage to install the facing F from the roll RF with the installed facing F trailing the carriage C. In such case, the user also manually pivots the frame 202 relative to the base B of the carriage C about pivot points V1,V2 such that the roll RF is urged into contact with the purlin lower flanges PL.

The present development provides a system and method and device for facing a roof structure, i.e., for installing facing F on the underside of roof purlins P1,P2 by securing the facing F to the purlin lower flanges PL. It is not intended that the present development be limited to the exact designs for the carriages C disclosed herein. In general, the present development is intended to encompass any carriage that carries and dispenses facing F for securement of the facing F to the lower flanges PL of purlins P (P1,P2, etc.) using adhesive such as tape or other adhesive, whether the tape or other adhesive is part of the facing, dispensed from the carriage and/or applied to the purlin flanges PL in a separate process before and/or after the facing is dispensed.

For all carriage embodiments, if desired or required for certain applications, the carriage can function merely as a dispenser for the roll of facing RF, meaning that the carriage can be operably suspended from the purlins P1,P2 and clamped or otherwise secured in position. Then the user can manually pull facing F from the roll RF and extend the facing along the length of the purlins P1,P2, navigating the facing around pipes, electrical conduits and other obstructions while adhering the facing to the bottom faces PF of the purlin lower flanges PL.

The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. A method of facing a roof structure, said method comprising:

securing a facing to respective lower flanges of first and second spaced-apart purlins of the roof structure, said facing extending directly between the respective lower flanges of the first and second purlins, wherein said securing step comprises using a first adhesive zone to adhere the facing directly or indirectly to a bottom face of said lower flange of said first purlin and using a second adhesive zone to adhere the facing directly or indirectly to a bottom face of said lower flange of said second purlin;

wherein said step of securing comprises:

suspending a carriage beneath said first and second purlins such that a first base portion of said carriage is suspended beneath said first purlin and a second base portion of said carriage is suspended beneath said second purlin by placing a first foot that is connected to said first base portion in contact with an upper surface of said lower flange of said first purlin and by placing a second foot that is connected to said second base portion in contact with an upper surface of said lower flange of said second purlin, wherein said first and second base portions of said carriage are connected to each other by at least one cross-member that extends between and interconnects said first and second base portions;

rotatably supporting a roll of said facing on said carriage beneath said first and second purlins with a first end of said roll located adjacent said lower flange of said first purlin from which said first base portion is suspended and an opposite second end of said roll located adjacent said lower flange of said second purlin from which said second base portion is suspended, said step of rotatably supporting said roll comprising rotatably supporting said first end of said roll relative to said first base portion of said carriage and rotatably supporting said opposite second end of said roll relative to said second base portion of said carriage such that said roll extends between said first and second base portions of said carriage;

urging said facing into contact with said bottom faces of said lower purlin flanges; and, dispensing said facing from said roll by moving said first and second feet of said carriage on said upper surfaces of the purlin flanges such that said carriage moves relative to and beneath said first and second purlins and said first adhesive zone and said second adhesive zone adhere said facing dispensed from said roll to said first and second purlins from which said carriage is suspended.

2. The facing method as set forth in claim 1, wherein each of said first and second adhesive zones is provided on at least one of said facing or said lower flange of said respective purlin.

* * * * *